US006210221B1

(12) United States Patent
Maury

(10) Patent No.: US 6,210,221 B1
(45) Date of Patent: Apr. 3, 2001

(54) MICROWAVE QUICK CONNECT/DISCONNECT COAXIAL CONNECTORS

(75) Inventor: Marc A. Maury, Claremont, CA (US)

(73) Assignee: Maury Microwave, Inc., Ontario, CA (US)

( * ) Notice: Subject to any disclaimer, the term of this patent is extended or adjusted under 35 U.S.C. 154(b) by 0 days.

(21) Appl. No.: 09/417,982

(22) Filed: Oct. 13, 1999

(51) Int. Cl.[7] ..... H01R 9/05
(52) U.S. Cl. ..... 439/578; 439/675
(58) Field of Search ..... 439/578, 581, 439/583, 584, 585, 675, 825, 349, 350, 180, 256, 254

(56) References Cited

U.S. PATENT DOCUMENTS

| | | | | |
|---|---|---|---|---|
| 3,292,136 | * | 12/1966 | Somerset | 439/584 |
| 3,340,495 | * | 9/1967 | Weinschel | 439/578 |
| 3,601,776 | * | 8/1971 | Curl | 439/675 |
| 4,561,716 | * | 12/1985 | Acke | 439/578 |
| 4,846,714 | | 7/1989 | Welsby et al. | 439/38 |
| 4,891,015 | | 1/1990 | Oldfield | 439/172 |
| 4,929,188 | * | 5/1990 | Lionetto et al. | 439/349 |
| 4,941,846 | | 7/1990 | Guimond et al. | 439/578 |
| 5,401,175 | | 3/1995 | Guimond et al. | 439/38 |
| 5,435,745 | * | 7/1995 | Booth | 439/583 |
| 5,879,188 | * | 3/1999 | Clyatt | 439/578 |
| 5,938,465 | * | 8/1999 | Fox, Sr. | 439/578 |

* cited by examiner

*Primary Examiner*—Renee Luebke
*Assistant Examiner*—Tho D. Ta
(74) *Attorney, Agent, or Firm*—Larry K. Roberts

(57) ABSTRACT

A versatile quick connect/disconnect coaxial 3.5 mm male connector which can be used to mate with unmodified standard SMA, 2.92 mm, and 3.5 mm female connectors with or without the use of a threaded nut. The connector employs simple construction and achieves excellent electrical performance. The connector allows the user the option of a push to engage and pull to disengage operating feature, plus the additional option to connect using a threaded nut with reduced thread engagement, which can be hand tightened or torqued to a specific value. The threaded nut is retractable and is held clear of the mating area for push/pull operation, and due to the minimum number of threads, the nut can be coupled and uncoupled in one third to one fourth the time needed to thread a conventional nut.

25 Claims, 4 Drawing Sheets

MICROWAVE QUICK CONNECT/DISCONNECT COAXIAL CONNECTORS

TECHNICAL FIELD OF THE INVENTION

This invention generally relates to microwave connectors and more specifically, to quick connect/disconnect coaxial connectors.

BACKGROUND OF THE INVENTION

In testing microwave devices, it is desirable to provide a connection which can be made quickly while providing low VSWR (Voltage Standing Wave Ratio), high isolation, and most importantly, repeatable measurements, ideally exhibiting repeatability greater than 40 dB. It is also desirable that the connection be stable and not require any external fixturing to insure repeatability, but may require support when used on a cable or test device which would normally require support during test.

Various quick disconnect coaxial connectors are described in U.S. Pat. Nos. 4,846,714; 4,891,015; 4,941,846; and 5,401,175. All of the above employ relatively complex and expensive methods for achieving a quick connect/disconnect feature for coaxial connectors.

SUMMARY OF THE INVENTION

A male slotted connector is described according to an aspect of the invention, which incorporates a compression ring that provides additional support to slotted and spread fingers of the outer conductor resulting in electrically repeatable couplings. The male connector can be mated to a female connector and connected and disconnected using a simple push on/pull off motion without the need for other action.

The connector may be used with an optional integral coupling nut to provide the option of a threaded coupling when performing calibration, or when verification of the measurement is desired. When used, the coupling nut provides engagement of one-half to one and one-half threads in one embodiment, providing the ability to quickly thread or unthread the mating connectors, or allowing a torqueable mating using industry standard torque wrenches.

This multi-function connector can be used to measure devices that utilize various types or sizes of female connectors, e.g.,SMA (Sub-Miniature Series A), 2.92 mm, or 3.5 mm female connectors. The female connector of these series connectors conventionally mate with a male connector that is screwed on and typically requires five to six revolutions of the coupling nut to mate.

The simplicity and ease of use of this invention, plus the low cost to manufacture, provides the user a low cost alternative to the more complex and costly methods currently available today.

Similar connectors can be provided using this coupling technique in connector types such as type N, TNC (Threaded Neille Concelman), 2.4 mm, 1.85 mm, 1.0 mm, and other sexed connectors with similar construction.

Another embodiment of the male connector employs a solid outer conductor structure with the compression ring.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENT

Figure 1:
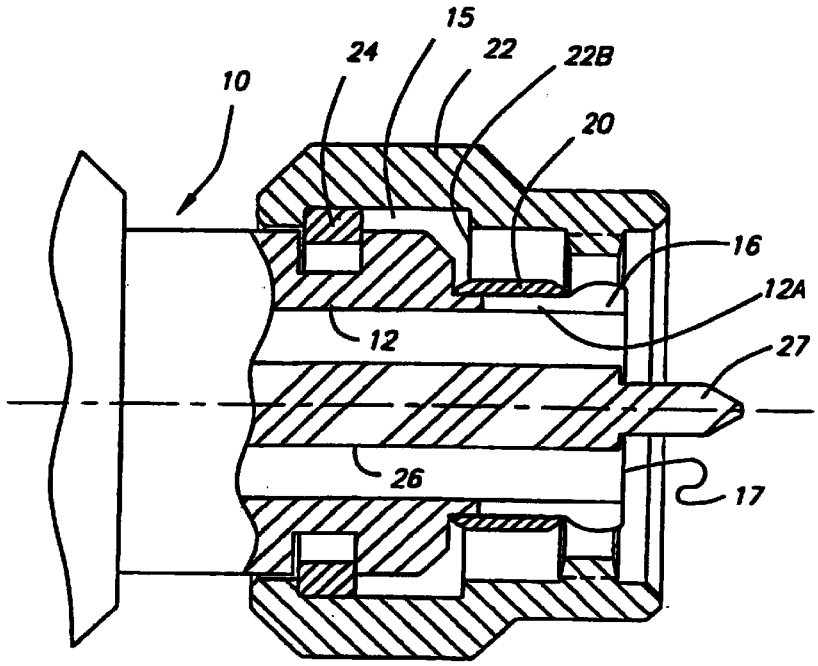
FIG. 1 is a partially broken-away, cross sectional view of a connector type embodying aspects of this invention, showing the configuration of the outside diameter of the outer conductor, and the placement of the compression ring, the nut, and retaining ring.

A male slotted connector 10 is illustrated in FIGS. 1–6, which incorporates a slotted outer conductor having spread fingers and a compression ring that provides additional support to the fingers, resulting in electrically repeatable couplings. This embodiment yields a quick disconnect configuration that provides excellent electrical specifications, and with the use of heat treated beryllium copper material also provides long life and reliable test characteristics. Conventional 3.5 mm connectors, 2.4 mm, 1.85 mm, and 1.0 mm connectors are only available with unslotted outer conductors.

The connector structure 10 includes a slotted outer conductor structure 12, having a plurality of slots 14 (FIG. 3) formed longitudinally in the leading end 16 of the outer conductor structure. The slots 14 separate finger regions 15 in the outer conductor structure 12. In an exemplary embodiment, the slots and the finger regions have a length of 0.100 inch.

Figure 4:
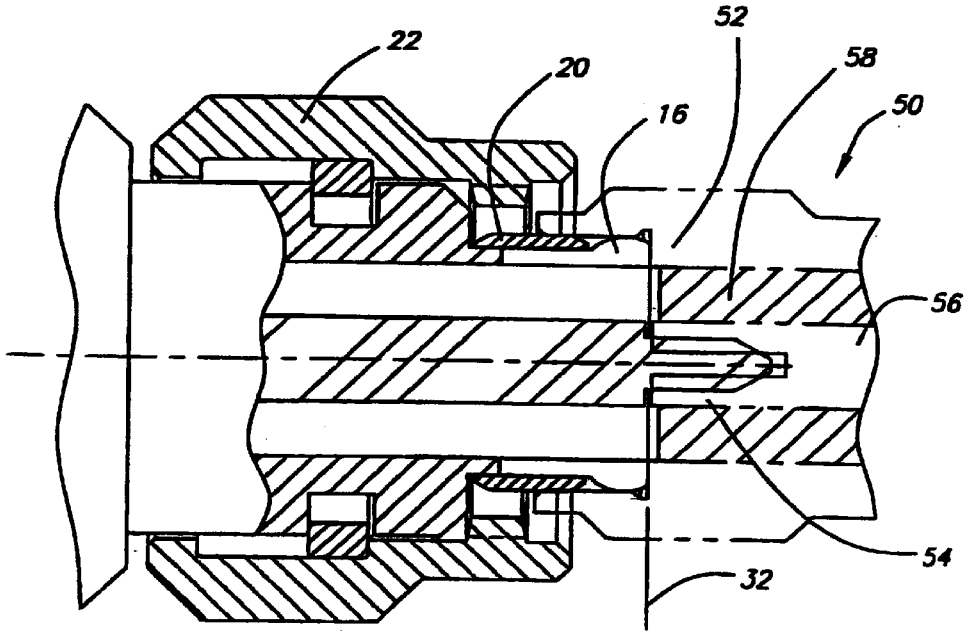
FIG. 4 is a partially broken-away, cross sectional view showing the connector of FIG. 1 mated with a female connector, showing the nut in the retracted position.
Figure 5:
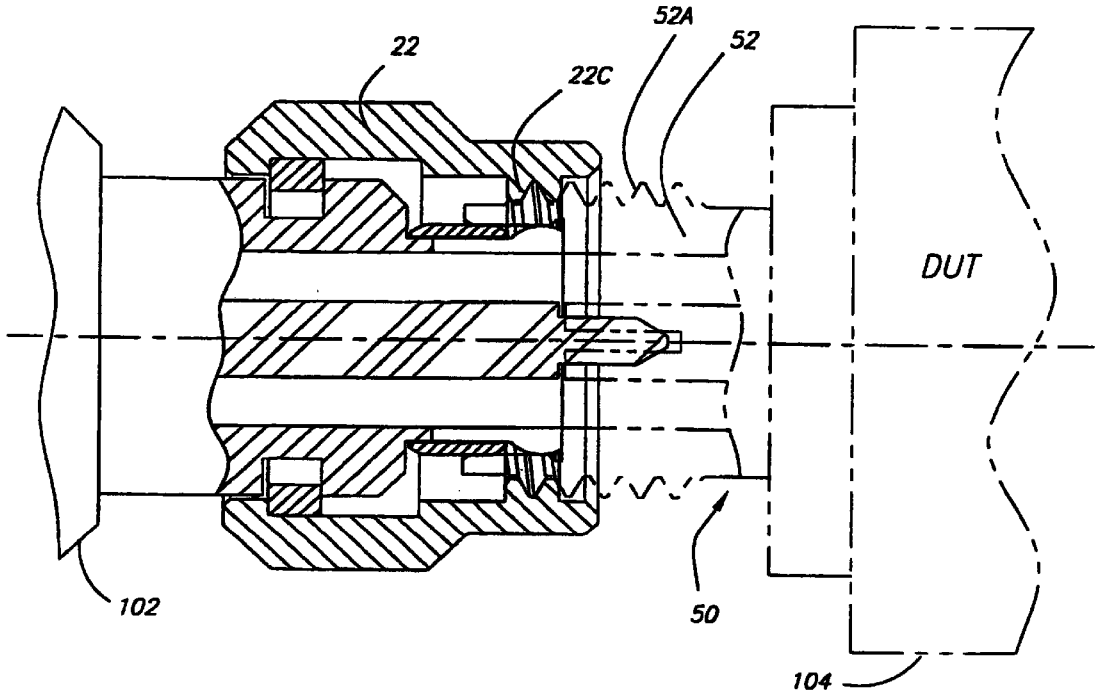
FIG. 5 is a partially broken-away, cross sectional view similar to FIG. 4, but showing the connector mated with a female connector showing the nut in a forward threaded position.
Figure 6:
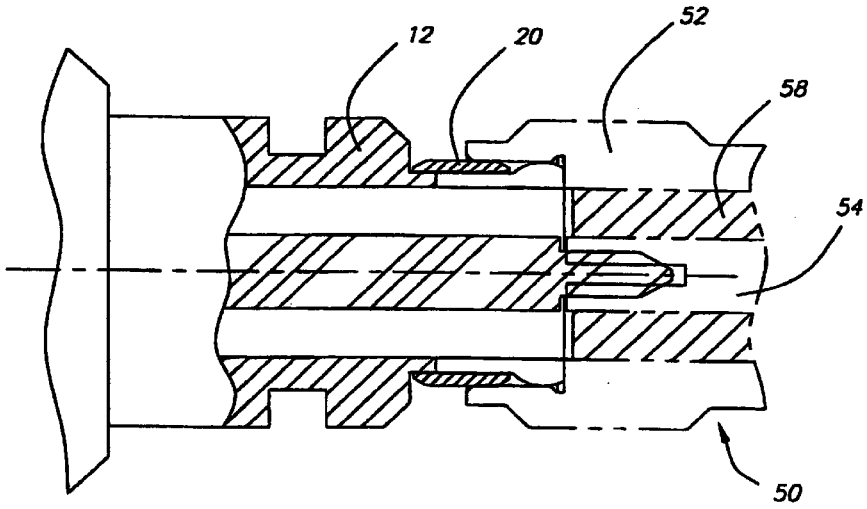
FIG. 6 is a cross sectional view similar to FIG. 5, less the nut and retaining ring.

The configuration of the leading end 16 of the outer conductor allows smooth entry and make excellent electrical contact with the inner diameter of the female connector 50 (FIGS. 4–6). The leading end 16 is radiussed with a smooth finish to provide a smooth wiping action on the female connector 50. It further features a flat end surface 17 to rest against a corresponding flat end surface of the female connector, thus minimizing any discontinuity at these mating surfaces of the respective connector structures.

A split compression ring 20 encircles the outer conductor structure 12 at region 12A, and is designed to exert force on the inner surface of the female connector 50 and provide mechanical stability. The ring is split to facilitate assembly onto the outer conductor structure 12. In this exemplary embodiment, the split ring is fabricated of heat treated beryllium copper, and is spread and held during the heat treatment to yield a ring diameter that provides optimal pressure against the inner surface of the mating female connector. Further, the ring is provided with a 30 degree lead-in chamfer on the outer diameter to assist entry into the female connector. As the ring compresses, it reduces the air gap over the outer diameter of the outer conductor between the outer conductor structure 12 and the female conductor structure 50. This in turn reduces RF leakage through the slots 14 in the outer conductor and eliminates radiation over a rated operating frequency range of the connector, which in this exemplary embodiment is from 0 to 26.5 GHz.

The finger regions 15 are spread to provide a compression fit with the inner circumferential surface of the female connector. The outer diameter of the outer structure 12 at the radiussed end of the outer conductor structure 12 is machined to a diameter of 0.181 inch +/− 0.0006 inch, in an exemplary embodiment, and the finger regions are then spread and heat treated with the diameter set at 0.189 inch +/− 0.0015 inch. The inner diameter of the corresponding female outer connector structure at its leading end for this embodiment is 0.1812 inch, and so the outer diameter of the outer structure at the leading end is slightly oversized with respect to the female connector structure. When engaged with the female connector structure, the inner surface of the female connector structure forces the spread finger regions 15 together and returns the inside diameter of outer conductor structure 12 at the slotted finger regions to the nominal 3.5 mm coaxial line size dimension of 0.1378 inch diameter. The radiussed leading end surfaces of the finger regions facilitate the engagement with the female connector structure.

Figure 7:
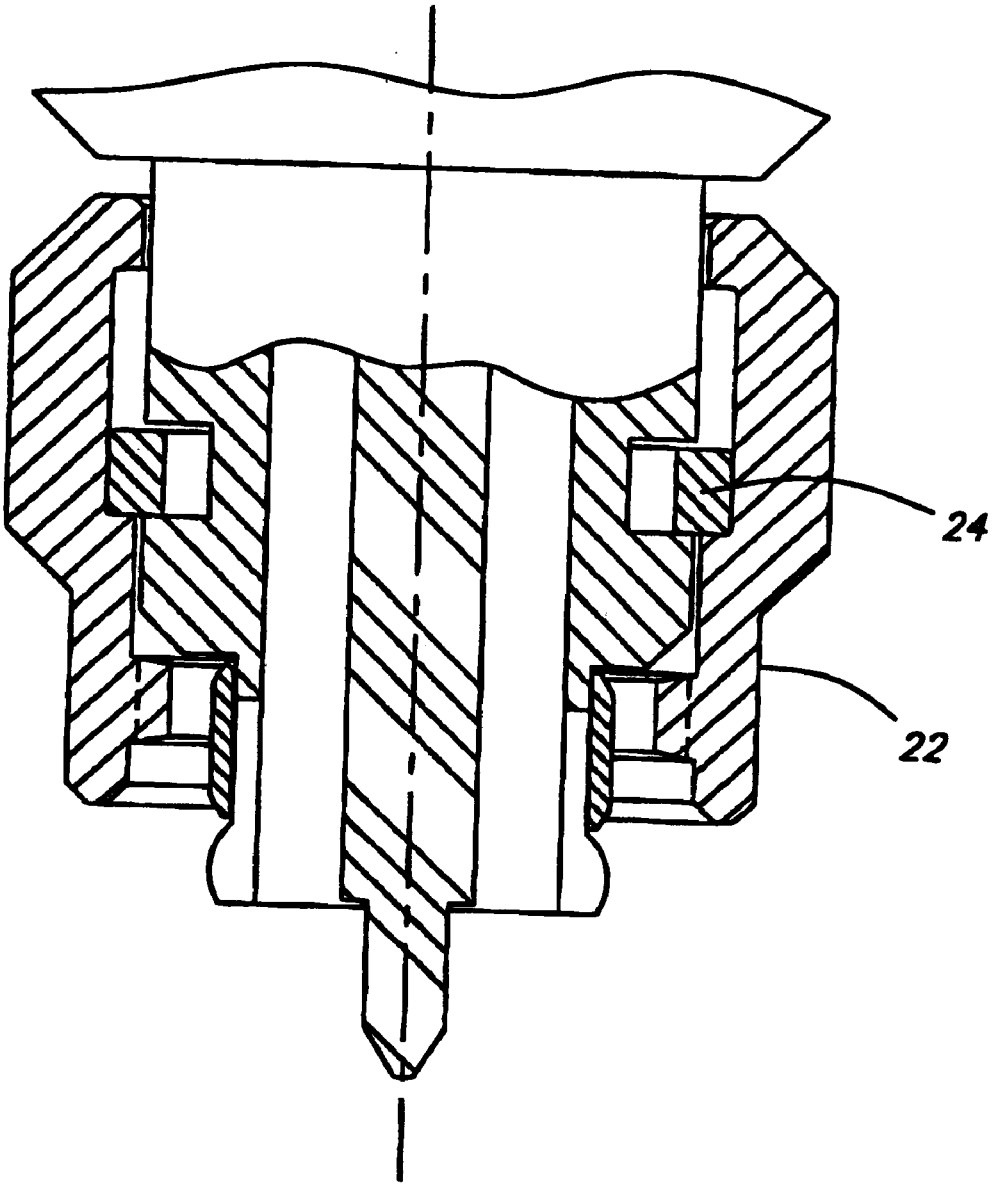
FIG. 7 is a cross-sectional view depicting the connector structure in a downwardly oriented position, showing the retention of the outer nut by a ring retainer.

A threaded coupling nut 22 with reduced thread engagement is held in place by a retaining ring 24. The coupling nut 22 is fabricated with an inner area between shoulders 22A, 22B of increased diameter, forming an elongated relief area 25. This relief area allows the coupling nut 22 to retract towards the rear of the connector 10 to ensure that the threads on the coupling nut do not contact the threads 52A on the female connector 52 (FIG. 5) should the user desire not to thread or couple the nut. Further, the retaining ring 24 exerts pressure on the coupling nut 22 when retracted, so that, should the connector be oriented with the nut 22 facing down, the retaining ring 24 exerts sufficient pressure to overcome the weight of the nut 22 and maintain it in a retracted position, as illustrated in FIG. 7. An exemplary material for the retaining ring is phosphor bronze.

The connector structure 10 further includes an inner conductor pin 26 with a leading end pin region 27 of reduced diameter with respect to that of the pin 26. The leading end pin region 27 in this exemplary embodiment has a reduced length as compared to prior connectors, to provide unrestricted entry into a mating female contact. The leading end pin region 27 has a length of 0.070 inch in this exemplary embodiment, as compared to a typical standard length of SMA pins of 0.090 inch and 3.5 mm connectors of 0.085 inch. Thus, in this exemplary embodiment, the reduced length of pin region 27 allows the entry of the outer conductor 12 into the female connector outer conductor structure 52 (FIGS. 4–6) prior to the pin region 27 engaging the socket 54 of the female contact structure 56. In the case of a SMA connector with a dielectric sleeve 58 about the female contact structure 56, the outer conductor 12 provides alignment of the pin region 27 during entry and therefore reduces the risk of damaging the mating female contact 56 or dielectric 58 by misalignment during insertion.

Figure 2:
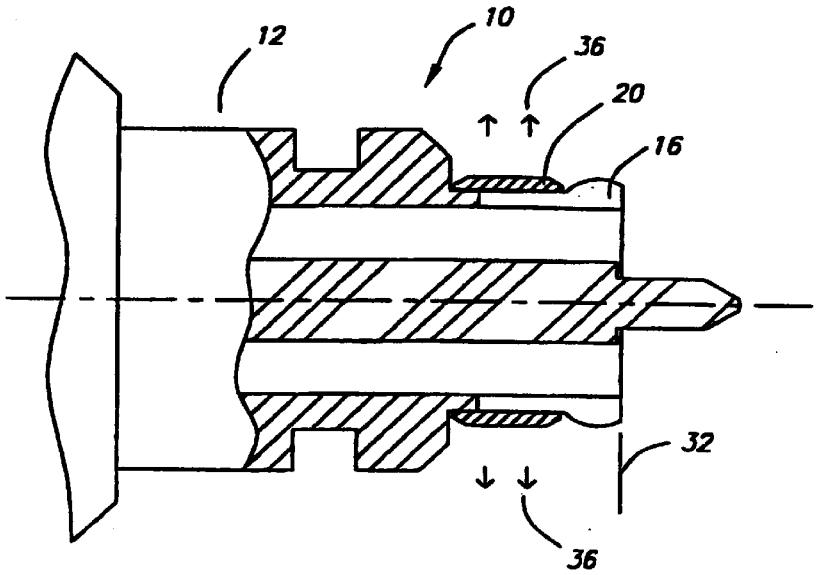
FIG. 2 is a view similar to FIG. 1, without the nut and retaining ring.

FIG. 2 shows the connector 10 with the coupling nut 22 and retaining ring 24 removed. This view illustrates the basic configuration to use the connector 10 for performing quick connect/disconnects during test. The nut 22 and retaining ring 24 are typically employed should the user desire to make a threaded coupling to verify the measurement accuracy or when a network analyzer calibration is being performed and the connector is used as the calibrated test port. Also, normal pressure applied (typical 8 in/lbs) for conventional connector structures to the mating interface 32 (FIGS. 2 and 4) is not necessary to achieve excellent repeatability of greater than 40 dB from 0 Hz to 26.5 GHz frequency range, even when the connection is coupled and de-coupled repeatably through 360° rotation. The arrows 36 in FIG. 2 indicate the direction of the applied force exerted by the outer conductor 12 and compression ring 20 on the female connector structure during and after mating.

Figure 3:
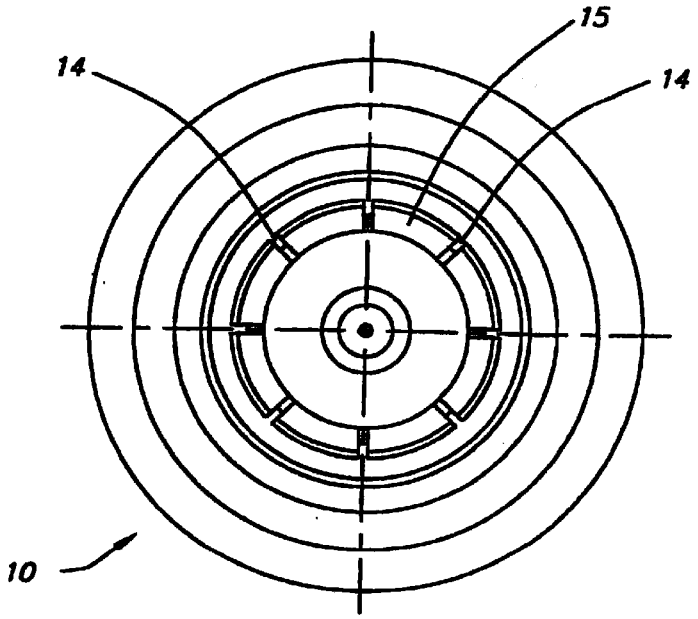
FIG. 3 is an end view showing the slotted outer conductor.

FIG. 3 shows an end view of the connector structure 10, and in this exemplary embodiment, the slots 14 are disposed at 45° spacings from adjacent slots. The number of slots is not critical to the invention, and the use of the compression ring 20 with a solid (unslotted) outer conductor structure 12 also provides satisfactory results for many applications. However, the slotted version exhibits better electrical performance. The width of the slots 14 is held as small as possible to minimize RF leakage at the higher operating frequencies. For this exemplary embodiment, in which the connector structure 12 has an inner diameter of 0.1378 inch when engaged with the female connector, the slots have a typical width of 0.006 inch.

FIG. 4 shows the connector structure 10 mated to an SMA type connector 50 having a dielectrically loaded interface 58. This view shows the normal retracted position of the coupling nut 22 as used during test and also shows the male connector outer conductor 12 and the female connector outer conductor 52 where they contact at the interface plane 32. In this view, the outer surfaces of the leading end 16 of the slotted connector structure 12 are shown in the compressed condition when fully engaged with initial pressure applied to the connector body. The nut is fully retracted and is not engaged or threaded during use. This mode of operation provides the user the recommended method to conduct quick tests using the connector structure 10.

The connector structure 10 in an exemplary test application is intended to be used, and will provide optimum results, where the device-under-test (DUT) is supported and where the device fixed with the connector structure 10 is also reasonably supported. FIG. 5 depicts a device 102 fixed to the connector structure 10, and a DUT (Device Under Test) 104 connected to the female connector structure 104. In this exemplary application, the device 102 could be a network analyzer.

FIG. 5 shows the coupling nut 22 with the threads 22C fully engaged with the threads 52C on the mating female connector 50. By virtue of the small number of threads present on the coupling nut, with a minimum of one thread, engagement and disengagement is very rapid and can typically be executed 2–3 times faster than engaging a standard fully threaded nut having 2–4 times the thread length. In this position, the coupling nut 22 can also be torqued to the recommended torque value of 8 in/lbs using a commercially available torque wrench. The electrical repeatability of a mated pair of connectors, when hand torqued or torqued using a torque wrench, is practically identical. This allows the user the option of torquing a mated pair of connectors during calibration or test to guarantee very exacting results, or hand torque the connectors very rapidly as a test mode of operation or to verify a push/pull, engage/disengage test where results of the mating are unstable for any reason. No known quick disconnect microwave connector provides this versatility of use.

FIG. 6 shows a configuration of the connector structure 10, less coupling nut 22 and retaining ring 24, mated to the female connector structure 50. In this configuration, the connector structure 10 can only be used in the push-to-engage, pull-to-disengage mode of operation. Here, the connector offers excellent electrical repeatability. This configuration is recommended where speed is of the essence in coupling the DUT to test devices and is ideal for manual or automated test fixtures or setups.

This configuration of slotted outer conductor 10, used in conjunction with a compression ring 20, can be applied to a variety of connector types having reasonably thick outer conductor walls which will allow a recess to be provided where the compression ring can reside, and where the normally solid outer conductor walls can be slotted and expanded to provide a spring compression fit with the mating female connector. If the conductor wall is too thin to allow a compression ring, the ring may be omitted with a slight degradation in performance.

Microwave connectors and test adapters employing this connector can be inexpensively produced and quickly connected and disconnected from a microwave coupling while maintaining a highly repeatable and low VSWR junction. Another aspect of this invention is a connector that can either be used in the push on/pull off mode or in the threaded mode as desired by the user.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A male coaxial connector structure for mating with a corresponding female connector structure to provide repeatable electrical connections at microwave frequencies, the male coaxial connector structure comprising:

an outer conductor structure having a central longitudinal axis and a central open region about the axis, the outer conductor structure having formed therein a plurality of longitudinally oriented slots in a leading end to form finger regions of the outer conductor structure, the outer conductor structure having a circumferential recess formed therein over a portion of the finger regions, the finger regions at the leading end having respective regions of increased outer dimension with respect to an outer dimension of the recess;

a center conductor pin structure disposed within the central open region and extending along the longitudinal axis;

a compression ring structure disposed about the outer conductor structure and positioned in said recess over the finger regions such that upon insertion of the male connector structure into the female connector structure, the regions of increased outer dimension of the finger regions engage and make electrical contact with the female connector structure, and the ring structure engages the female connector structure and the finger regions to mechanically support the finger regions of the outer conductor structure resulting in electrically repeatable couplings.

2. The male connector structure of claim 1 wherein the finger regions are fabricated of a resilient material, and are spread outwardly to form an oversized leading end outer diameter, and wherein upon engagement of the end regions of the finger regions with the female connector structure, the end regions of the finger regions are compressed to a nominal connector diameter.

3. The male connector structure of claim 1 wherein the compression ring structure is fabricated of an electrically conductive material, wherein the compression ring provides shielding against leakage of RF energy through said slots.

4. The male connector structure of claim 1 wherein said outer conductor structure and said compression ring structure are fabricated of beryllium copper.

5. The male connector structure of claim 1, wherein the outer conductor structure and compression ring structure are adapted for connection and disconnection with the female connector structure using a simple push on/pull off motion without the need for other action.

6. The male connecter structure of claim 5 further comprising:

an integral coupling nut disposed about the outer conductor structure to provide the option of a threaded coupling with the female connector structure.

7. The male connector structure of claim 6 wherein the coupling nut is threaded so as to provide engagement of one-half to one and one-half threads with a threaded structure on the female connector structure, providing the ability to quickly thread or unthread the coupling nut from the threaded structure.

8. The male connector structure of claim 6 wherein the coupling nut is fabricated with an inner area between inner spaced shoulders of increased diameter, forming an elongated relief area which allows the coupling nut to retract to ensure that the threads on the coupling nut do not contact threads on the female connector structure should the user desire not to thread or couple the nut.

9. A male coaxial connector structure for mating with a corresponding female connector structure to provide repeatable electrical connections at microwave frequencies, the male coaxial connector structure comprising:

an outer conductor structure having a central longitudinal axis and a central open region about the axis, the outer conductor structure having formed therein a plurality of longitudinally oriented slots in a leading end to form finger regions of the outer conductor structure, the leading end adapted to make electrical contact with a corresponding leading end of the female connector structure, the outer conductor structure having a circumferential recess formed therein over a portion of the finger regions, the finger regions at the leading end having respective regions of increased outer dimension with respect to an outer dimension of the recess;

a center conductor pin structure disposed within the central open region and extending along the longitudinal axis for mating engagement with a corresponding socket structure of the female connector structure; and a compression ring disposed about the outer conductor structure in the recess over a portion of the finger regions and positioned such that upon insertion of the male connector structure into the female connector structure, the regions of increased outer diameter of the finger regions engage and make electrical contact with the female connector structure, and the ring engages the female connector structure and the finger regions of the outer conductor structure to support the finger regions resulting in electrically repeatable couplings.

10. The male connector structure of claim 9 wherein said outer conductor structure is fabricated of beryllium copper.

11. The male connector structure of claim 9 wherein the finger regions are fabricated of a resilient material, and are spread outwardly to form an oversized leading end outer diameter, and wherein upon engagement of the end regions of the finger regions with the female connector structure, the finger regions are compressed to a nominal connector diameter.

12. The male connector structure of claim 9, wherein the outer conductor structure is adapted for connection and disconnection with the female connector structure using a simple push on/pull off motion without the need for other action.

13. The male connecter structure of claim 12 further comprising:

an integral coupling nut disposed about the outer conductor structure to provide a threaded coupling with the female connector structure.

14. The male connector structure of claim 13 wherein the coupling nut is threaded so as to provide engagement of one-half to one and one-half threads with a threaded structure on the female connector structure, providing the ability to quickly thread or unthread the coupling nut from the threaded structure.

15. The male connector structure of claim 13 wherein the coupling nut is fabricated with an inner area between inner spaced shoulders of increased diameter, forming an elongated relief area which allows the coupling nut to retract to ensure that the threads on the coupling nut do not contact threads on the female connector structure should the user desire not to thread or couple the nut.

16. A male coaxial connector structure for mating with a corresponding female connector structure to provide repeatable electrical connections at microwave frequencies, the male coaxial connector structure comprising:

an outer conductor structure having a central longitudinal axis and a central open region about the axis, the outer conductor structure having a leading end adapted to make electrical contact with a corresponding leading end of the female connector structure when mated together, the outer conductor structure having formed therein a plurality of longitudinally oriented slots in the leading end to form finger regions of the outer conductor structure;

a center conductor pin structure disposed within the central open region and extending along the longitudinal axis;

a split compression ring disposed about the outer conductor structure and positioned over the finger regions such that upon insertion of the male conductor structure into the female connector structure, the ring slidingly engages the female connector structure and compresses due to engagement with the female connector structure to mechanically engage and support the finger regions of the outer conductor structure resulting in electrically repeatable couplings.

17. The male connector structure of claim 16 wherein the compression ring is fabricated of an electrically conductive material, wherein the compression ring provides shielding against leakage of RF energy through gaps between the male outer conductor structure and the female connector structure.

18. The male connector structure of claim 16, wherein the outer conductor structure and compression ring are adapted for connection and disconnection with the female connector structure using a simple push on/pull off motion without the need for other action.

19. The male connecter structure of claim 18 further comprising:

an integral coupling nut disposed about the outer conductor structure to provide the option of a threaded coupling with the female connector structure.

20. The male connector structure of claim 19 wherein the coupling nut is threaded so as to provide engagement of one-half to one and one-half threads with a threaded structure on the female connector structure, providing the ability to quickly thread or unthread the coupling nut from the threaded structure.

21. The male connector structure of claim 19 wherein the coupling nut is fabricated with an inner area between inner spaced shoulders of increased diameter, forming an elongated relief area which allows the coupling nut to retract to ensure that the threads on the coupling nut do not contact threads on the female connector structure should the user desire not to thread or couple the nut.

22. A method for making an electrical connection at microwave frequencies, comprising:

providing a female coaxial connector structure having an outer female connector structure with an inner diameter size and an inner conductor structure;

providing a male connector structure including an outer conductor structure having a central longitudinal axis and a central open region about the axis, the outer conductor structure having formed therein a plurality of longitudinally oriented slots in a leading end to form finger regions of the outer conductor structure, the outer conductor structure having a circumferential recess formed therein and spaced from the leading end, the finger regions at the leading end having respective regions of increased outer dimension with respect to an outer dimension of the recess, and a center conductor pin structure disposed within the central open region and extending along the longitudinal axis, and wherein the finger regions are spread such that the outer diameter of the leading edge is oversized with respect to the inner diameter size of the female connector structure, and a compression ring structure disposed about the outer conductor structure and positioned in said recess; and engaging the male connector structure with the female connector structure such that the inner conductor structure makes contact with the center conductor pin structure and the leading end of the outer conductor structure is inserted into the outer female connector structure, the finger regions forming a compression fit with the outer female connector structure and the leading end is compressed to a nominal connector diameter, and such that upon insertion of the male connector structure into the female connector structure, the end regions of the finger regions engage and make electrical contact with the female connector structure, and the ring structure slidingly engages the female connector structure and mechanically supports the finger regions of the outer conductor structure resulting in electrically repeatable couplings.

23. A male coaxial connector structure for mating with a corresponding female connector structure to provide repeatable electrical connections at microwave frequencies, the male coaxial connector structure comprising:

an outer conductor structure having a central longitudinal axis and a central open region about the axis, the outer conductor structure having formed therein a plurality of longitudinally oriented slots in a leading end to form finger regions of the outer conductor structure;

a center conductor pin structure disposed within the central open region and extending along the longitudinal axis;

a compression ring structure disposed about the outer conductor structure and positioned such that upon insertion of the male connector structure into the female connector structure, the ring structure slidingly engages the female connector structure and supports the finger regions of the outer conductor structure resulting in electrically repeatable couplings;

an integral coupling nut disposed about the outer conductor structure to provide the option of a threaded coupling with the female connector structure, the coupling nut fabricated with an inner area between inner spaced shoulders of increased diameter, forming an elongated relief area which allows the coupling nut to retract to ensure that the threads on the coupling nut do not contact threads on the female connector structure should the user desire not to thread or couple the nut.

24. A male coaxial connector structure for mating with a corresponding female connector structure to provide repeatable electrical connections at microwave frequencies, the male coaxial connector structure comprising:

an outer conductor structure having a central longitudinal axis and a central open region about the axis, the outer conductor structure having formed therein a plurality of longitudinally oriented slots in a leading end to form finger regions of the outer conductor structure, the leading end adapted to make electrical contact with a corresponding leading end of the female connector structure;

a center conductor pin structure disposed within the central open region and extending along the longitudinal axis for mating engagement with a corresponding socket structure of the female connector structure; and a coupling nut disposed about the outer conductor structure to provide a threaded coupling with the female connector structure, wherein the coupling nut is fabricated with an inner area between inner spaced shoulders of increased diameter, forming an elongated relief area which allows the coupling nut to retract to ensure that the threads on the coupling nut do not contact threads on the female connector structure should the user desire not to thread or couple the nut.

25. A male coaxial connector structure for mating with a corresponding female connector structure to provide repeatable electrical connections at microwave frequencies, the male coaxial connector structure comprising:

an outer conductor structure having a central longitudinal axis and a central open region about the axis, the outer conductor structure having a leading end adapted to make electrical contact with a corresponding leading end of the female connector structure when mated together;

a center conductor pin structure disposed within the central open region and extending along the longitudinal axis;

a compression ring disposed about the outer conductor structure and positioned such that upon insertion of the male conductor structure into the female connector structure, the ring slidingly engages the female connector structure and supports the outer conductor structure resulting in electrically repeatable couplings;

an integral coupling nut disposed about the outer conductor structure to provide the option of a threaded coupling with the female connector structure, wherein the coupling nut is fabricated with an inner area between inner spaced shoulders of increased diameter, forming an elongated relief area which allows the coupling nut to retract to ensure that the threads on the coupling nut do not contact threads on the female connector structure should the user desire not to thread or couple the nut.

* * * * *